United States Patent [19]

Jaulmes

[11] 3,949,725

[45] Apr. 13, 1976

[54] IMPROVEMENTS MADE TO THE LUBRICATION OF ENGINES

[75] Inventor: Eric Jaulmes, Paris, France

[73] Assignee: Ateliers de la Motobecane, Pantin, France

[22] Filed: Dec. 31, 1974

[21] Appl. No.: 537,827

[30] Foreign Application Priority Data

Mar. 11, 1974 France ..... 74.08225

[52] U.S. Cl. ..... 123/196 R; 184/6.5

[51] Int. Cl.[2] ..... F01M 1/00

[58] Field of Search ..... 123/196 R; 84/6.5

[56] References Cited

FOREIGN PATENTS OR APPLICATIONS 2,166,448 7/1973 France ..... 123/196 R

*Primary Examiner*—Charles J. Myhre
*Assistant Examiner*—William C. Anderson
*Attorney, Agent, or Firm*—Browdy and Neimark

[57] ABSTRACT

A system for separate oil lubrication for internal combustion engines, especially for 2-cycle engines, comprises a tank of oil under pressure and a pump composed of a shaft engaged inside a bore with slight play, at least one of these two elements being threaded and the other being smooth or threaded, these two elements being in relative rotation.

4 Claims, 5 Drawing Figures

IMPROVEMENTS MADE TO THE LUBRICATION OF ENGINES

FIELD OF THE INVENTION

The invention relates to the lubrication of internal combustion engines and, more particularly, to a system of separate oil lubrication for 2-cycle internal combustion engines.

BACKGROUND OF THE INVENTION

French Pat. No. 2,166,448 granted to the applicant describes a system of feeding oil to a 2-cycle engine, which system also incorporates a means for interrupting the flow of the oil at rest, essentially composed of a centrifugal valve located downstream from the pump, acting against a means of elastic return and closed when at rest under the action of the latter.

According to a specific embodiment described in the above-cited patent, the centrifugal valve is mounted on a part which rotates around a shaft and an oil feed channel is provided in this part. The successive sections of this channel are located on the radii of gyration which, in the direction of flow of the oil, are constant or tend to increase, but never decrease.

When the part turns, centrifugal force operates on the one hand to open the valve and on the other hand causes the drops of oil to travel along the feed channel, these drops being subjected to a centrifugal force field which never decreases as they travel along their route.

Taking for example a small-capacity motorcycle engine, for example 50 cc, the oil flow rate will be on the order of 7 to 14 cubic mm per second. With a feed channel with a section of about 3 $mm^2$, this flow would amount to an average oil velocity of about 2–5 mm per second, disregarding the influence of centrifugal force.

In reality, however, this centrifugal force reaches higher values. Thus, for a rotational velocity of the rotating part on the order of 3,000 rpm, the acceleration produced by this force is about 250 g (g being the acceleration due to gravity) at a distance of 2.5 centimeters from the center.

Under these conditions, the oil, which is fed in small amounts by the viscosity-type feed pump, is very strongly accelerated by the centrifugal force and there is not a continuous column of oil in the feed channels. As a result, the pressure of the gases contained in the engine crankcase where the oil is distributed is exerted right up to the outlet of the feed pump.

This system operates satisfactorily in an engine in good condition. In fact, the crankcase gases are subject to alternations in pressure of about 0.5 kilograms per square centimeter for example during the operating cycle, and to rarefaction which can reach 0.35 to 0.40 kilograms per square centimeter. On the average, the crankcase gases are therefore at a slight overpressure with respect to the atmosphere.

However, engines, and especially motorcycle engines, are often poorly maintained, and the exhaust manifold as well as the muffler may have deposits such as calamine. The load loss in the exhaust therefore increases and causes an increased gas pressure in the engine crankcase. This higher pressure is insufficient to counterbalance the centrifugal force in the feed channel, but when it spreads to the feed pump, whose outlet pressure hardly exceeds 0.2 to 0.3 kilogram per square centimeter, it can interrupt the flow of the latter and dry up the lubricating device.

SUMMARY

It is, accordingly, an object of the present invention to remedy this defect; it is another object to provide for improved internal combustion engine lubrication; and yet another object to provide an improved system for the lubrication of internal combustion engines, particularly 2-cycle engines.

The system in general comprises a tank of oil under pressure and a pump composed of a shaft engaged inside a bore with slight play, at least one of these two elements being threaded and the other being smooth or threaded, these two elements being in relative rotation. According to the present invention, the feed channel for the oil consists of a first section adjacent to the valve whose successive portions in the direction of the oil flow beyond the valve are located on decreasing radii of gyration, and this first section is followed by a second section whose successive portions are situated on increasing radii of gyration.

Thus, the centrifugal acceleration to which the oil particles are subjected upon their emergence from the valve is at a minimum. Consequently, on both sides of the valve, there is a buildup of oil due to an effect analogous to that causing an accumulation of water in the U-tube of a water closet, for example, the centrifugal force in the system according to the invention like gravity in the siphon. This oil buildup at high pressure protects the feed pump against the pressure from the crankcase gases.

Other characteristics and advantages of the invention will emerge from the detailed description of an embodiment which follows.

DETAILED DESCRIPTION OF THE PREFERRED EMBODIMENTS

Figure 1:
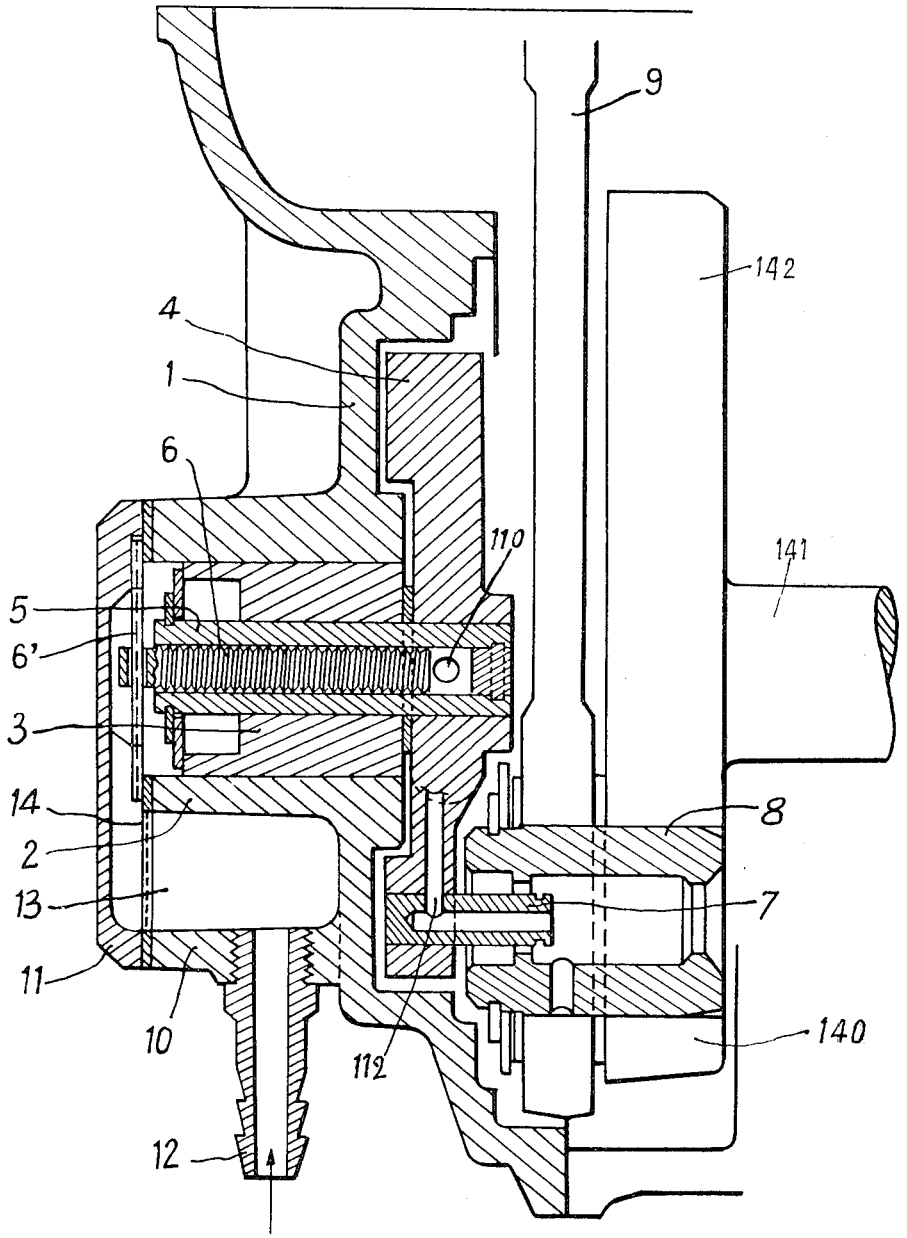
FIG. 1 is a longitudinal cross-section of a system in accordance with the present invention.

FIG. 1 shows the crankcase of a two-cycle internal combustion engine, in which a half-crankshaft is rotating. A half-crankshaft is understood to be the assembly composed of a shaft 141, a crank arm 140 normal to this shaft 141 and supporting a crankpin 8 acted upon by the head of a connecting rod 9 linked to a piston of the engine, and a counterweight 142 counteracting the crank arm 140 relative to the shaft 141. The crankpin 8 sets rotating, by means of a hollow pin 7, a rotational part, which in this version is a plate 4 whose axis coincides with the axis of the crankshaft 141.

Plate 4 has a hub composed of a sleeve 5 which turns in a journal 3 supported by a boss 2 in the crankcase. A threaded shaft 6 coaxial with sleeve 5 is engaged in the latter with a small amount of play, about 1/100 of a millimeter, and is fixed to boss 2 by means of a crossbar 6', for example.

A casing 10, closed by a cover 11, is formed in crankcase 1 and contains a joint 12 or a supply channel for oil which is connected to a pressurized tank (not shown). Casing 10 delimits an oil chamber 13 which communicates through a filter 14 with one end of sleeve 5, the other end of sleeve 5 being closed by a plug.

When plate 4 and its sleeve 5 are set rotating by the crankshaft, the oil which is between the threaded shaft 6 and the inside wall of sleeve 5 is set rotating by virtue of its viscosity. The presence of the threads in shaft 6 thus communicates to the oil an axial velocity component, with the whole thus functioning as a feed pump whose flow rate is substantially proportional to the velocity of rotation of the engine.

As explained in French Pat. No. 2,166,448, this pump can likewise be created with a fixed smooth part and a rotating threaded part, or the two coaxial parts of the pump may be threaded either in the same direction with different pitches or in opposite directions. Likewise plate 4 can turn around a different axis from that of the crankshaft and can be driven by the latter by means of a train of gears.

Figure 2:
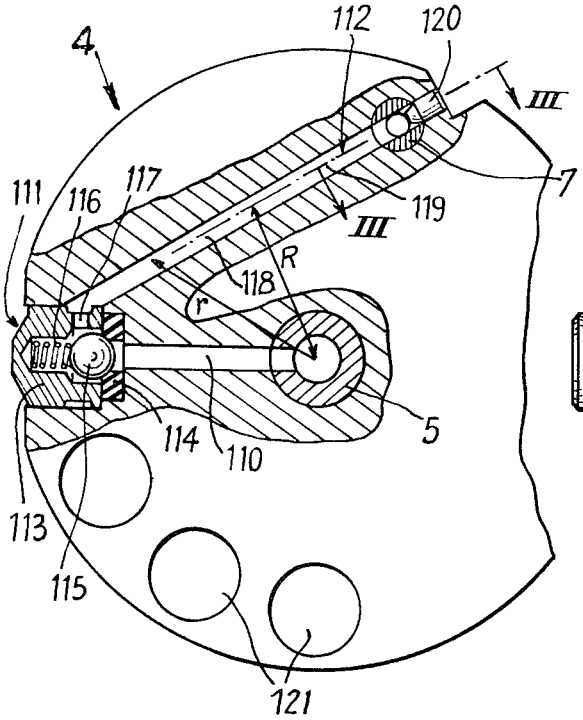
FIG. 2 is an elevation, with partial cross-sections, of the plate of the system according to FIG. 1.
Figure 3:
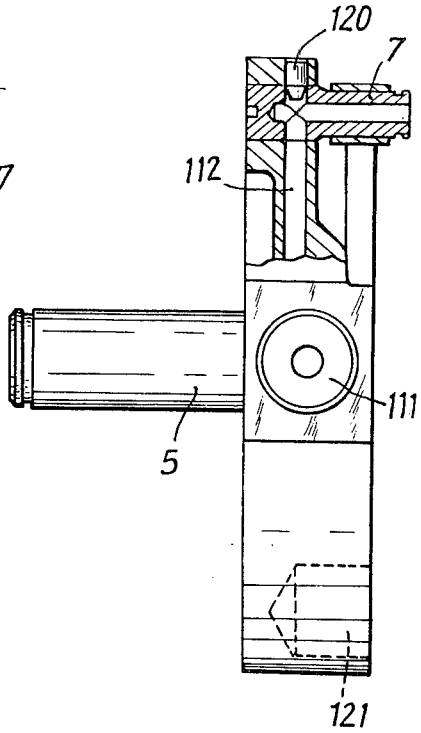
FIG. 3 is a profile view corresponding to FIG. 2 with a partial cross-section along line III—III in FIG. 2.

The internal bores of sleeve 5 and pin 7 are connected by channels made inside plate 4 (FIGS. 2 and 3). A connecting channel 110 which runs essentially radially connects the bore of sleeve 5 with the inlet of a centrifugal valve 111, whose outlet is connected to the bore of pin 7 by a feed channel 112. At the outlet of the bore of pin 7, the oil is distributed into the motor crankcase.

The centrifugal valve 111 is located near the periphery of the plate 4, where the centrifugal force is greatest, and comprises a housing 113 and a seat 114 located at the opening of connecting channel 110. Element 113 provides a seat for a calibrated spring 116 which tends to push the ball against the seat 114. The housing 113 also has a passage 117 which connects the housing interior with the feed channel 112.

The feed channel 112 consists of two sections. A first section 118 immediately adjacent to valve 111 is disposed such that its successive portions, running in the direction of the flow of the oil as it leaves the valve, are located on the radii of gyration which decrease down to a minimum value R. The second section 119 follows the first and has its successive portions located on the radii of gyration which increase in the direction of the flow of the oil. Section 119 terminates in the bore of hollow pin 7, after which it is blocked by a plug 120.

From FIG. 3 it can be seen that, in the region which contains the feed channel 112 and the pin 7, the thickness of the plate 4 is less than in the opposite region. Holes 121 are made in this opposite thicker region to insure dynamic balance of the plate.

Experience has shown that, in the above-described system, the flow from the feed pump is not interrupted when the pressure of the gases in the engine crankcase increases.

This experimental result can be accounted for as follows, an explanation which in no case constitutes a limitation of the invention.

When plate 4 rotates, for example at the rotational velocity of the engine, ball 115 under the influence of centrifugal force pushes against spring 116 and releases from its seat 114, which action causes channels 110 and 112 to communicate.

Figure 5:
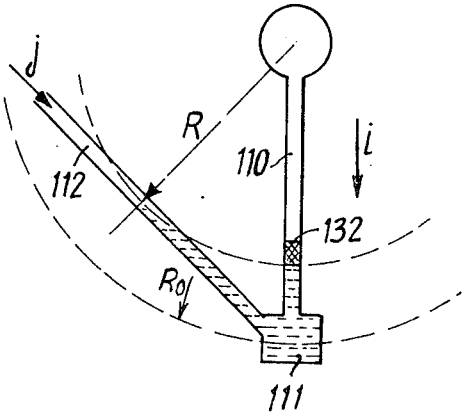

The oil particles discharge by the feed pump are sucked by centrifugal force into connecting channel 110 and accumulate in the seat of valve 111 and the adjacent regions of channels 110 and 112, as shown in FIG. 5.

This accumulation of oil may be viewed as playing a role similar to that of a classical siphon located for example at the outlet of a water closet or a wash basin.

In the latter case (FIG. 4), the water coming from inlet 130 of the siphon accumulates under the influence of the field of gravity which acts in the direction of *f*, between the maximum level *h* and minimum level *b* of the siphon. These two levels represent the equilibrium levels of the mass of water which has accumulated when no more water arrives at inlet 130, assuming that the gas pressures at the inlet and outlet of the siphon are the same.

If we add an additional quantity of water to inlet 130, equilibrium is destroyed and a practically equivalent amount of water will flow out of the outlet of the siphon.

Figure 4:
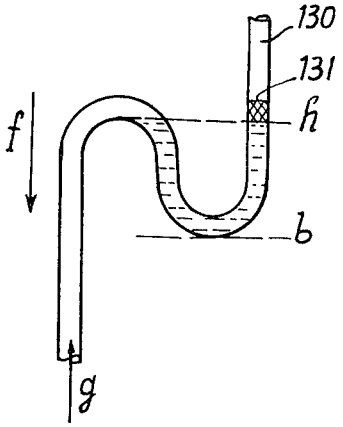
FIGS. 4 and 5 are schematic drawings which explain the system's operation.

On the other hand, if more pressure acts in the direction of arrow g on the outlet than on the inlet, the water level will rise, as shown at 131 in FIG. 4, in the arm of the siphon connected to the inlet, and the weight per unit area of this additional water column will offset the excess pressure.

In the lubricating system according to the invention (FIG. 5), the centrifugal force field which acts in the direction of arrow *i* plays the role of the gravity field in the case of the siphon in FIG. 4. We have already seen that the centrifugal acceleration is much stronger than that of gravity which can therefore be disregarded, at least in the areas near centrifugal valve 111. The oil therefore accumulates between the spheres of maximum radius $R_0$ and minimum radius R, which correspond respectively to levels *b* and *h*, if the pressures at the pump inlet side and the crankcase outlet side are the same. The oil particles discharged by the pump accumulate in channel 110 and in the portion of channel 112 extending between valve 111 and the intersection of radius R, causing evacuation of an equivalent amount of oil through channel 112. This oil then follows a path located along the radii of gyration increasing beyond the value R and is consequently subjected to increasingly strong centrifugal accelerations until it reaches the bore of pin 7. Hence, there is not a continuous oil column in channels 111 and 112 outside the shaded zones in FIG. 5.

Assuming now that the gas pressure in the engine crankcase, which is acting in the direction of arrow *j*, increases, there will be an additional accumulation of oil 132 on the inside circle with radius R, in the connecting channel 110. This additional mass of oil will exert a presure which counterbalances the excess pressure in the crankcase, so that the pressure at the feed pump outlet becomes practically constant and this pump can continue to feed the oil.

Noting that this additional mass is very small because the pressure which it exerts results not from its weight but from the centrifugal force, which produces in this region an acceleration much greater than that of gravity, a column of oil with a density 0.9 contained between spheres of radii equal respetively to 0.5 and 2.5 centimeters can offset at a velocity of 3,000 rpm, an excess pressure on the order of 300 grams per square centimeter between the inlet and outlet of the oil siphon.

The rotating part which consists of the centrifugal valve and the feed channels, instead of being formed by a plate 4 (FIG. 1) driven by a half-crankshaft, can constitute a part of the crankshaft itself and for example may be constituted by the crankarm of a second half-crankshaft similar to the one shown in FIG. 1 and linked to the latter by crank pin 8. Such a system is shown in FIG. 5 in French Pat. No. 2,166,448.

It will be obvious to those skilled in the art that various changes may be made without departing from the scope of the invention and the invention is not to be considered to be limited to what is shown in the drawings and described in the specification.

What is claimed is:

1. In a device for separate-oil lubrication for internal combustion engines, especially for two-cycle engines, said system comprising a pressurized oil tank, an oil pump driven by the engine;

a centrifugal valve integral with a part which is rotational about an axis, means for driving said part in rotation around said axis, a connecting channel linking an outlet of said oil pump to the inlet of said valve, and a feed channel arranged inside said rotational part and linking the outlet of said valve to a distribution point for the oil in the engine, the improvement consisting in that said feed channel comprises a first section adjacent to the valve and having successive portions downstream from said valve in the direction of oil flow located on decreasing radii of gyration, and a second section located beyond the first section in the direction of the flow of the oil between said first section and said distribution point, the successive portions of said second portion in the direction of said flow being located on increasing radii of gyration.

2. The device according to claim 1, wherein the axis of rotation of the part coincides with the axis of the crankshaft of the engine.

3. The device according to claim 1, wherein the part further includes said centrifugal valve with a ball and calibrated spring located in the vicinity of the periphery of said rotational parts, the inlet of said valve being connected to the outlet of said oil pump by a connecting channel located substantially radially with respect to said outlet and the outlet of said valve being connected to said feed channel.

4. The device according to claim 1, wherein the part is a plate set rotating by the crankarm of a half-crankshaft.

* * * * *